US006274981B1

(12) United States Patent
Ronda et al.

(10) Patent No.: US 6,274,981 B1
(45) Date of Patent: Aug. 14, 2001

(54) LOW-PRESSURE MERCURY VAPOR DISCHARGE LAMP WITH ELECTRODE SHIELD

(75) Inventors: Cornelis R. Ronda, Aachen (DE); Cornelis J. M. Denissen, Nuth (NL); Volker U. Weiler, Aachen (DE); Wilhelm A. Groen, Limbricht (NL); Wilhelmus M. P. Van Kemenade; Bennie J. De Maagt, both of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/304,554

(22) Filed: May 4, 1999

(30) Foreign Application Priority Data

May 8, 1998 (EP) ..... 98201549

(51) Int. Cl.[7] ..... H01J 61/10
(52) U.S. Cl. ..... 313/613; 313/492
(58) Field of Search ..... 313/492, 613, 313/616, 609

(56) References Cited

U.S. PATENT DOCUMENTS

| | | | | |
|---|---|---|---|---|
| 2,946,909 | * | 7/1960 | Morehead | 313/486 |
| 2,959,702 | * | 11/1960 | Beese | 313/492 |
| 4,032,813 | * | 6/1977 | Shurgan et al. | 313/492 |
| 4,588,919 | | 5/1986 | Kroontje et al. | 313/25 |
| 5,686,795 | * | 11/1997 | Sakoske et al. | 313/613 |
| 6,049,164 | * | 4/2000 | Van Kemenade et al. | 313/492 |

FOREIGN PATENT DOCUMENTS 1060991 2/1957 (DE) .

* cited by examiner

*Primary Examiner*—Michael H. Day
(74) *Attorney, Agent, or Firm*—Dicran Halajian

(57) ABSTRACT

A low-pressure mercury vapor discharge lamp is provided with a discharge vessel and a first and a second end portion (12*a*). The discharge vessel encloses a discharge space provided with a filling of mercury and a rare gas in a gastight manner. Each end portion (12*a*) supports an electrode (20*a*) arranged in the discharge space. An electrode shield (22*a*) encompasses the electrodes (20*a*) and is covered with a material which reacts with or forms an alloy with alkaline earth metals, which material is released by the electrode (20*a*).

18 Claims, 3 Drawing Sheets

LOW-PRESSURE MERCURY VAPOR DISCHARGE LAMP WITH ELECTRODE SHIELD

BACKGROUND OF THE INVENTION

The invention relates to a low-pressure mercury vapor discharge lamp comprising a discharge vessel, which discharge vessel encloses a discharge space provided with a filling of mercury and a noble gas in a gastight manner, electrodes being arranged in the discharge space for generating and maintaining a discharge in the discharge space, and an electrode shield at least substantially surrounding at least one of the electrodes.

In mercury vapor discharge lamps, mercury is the primary component for (efficiently) generating ultraviolet (UV) light. An inside wall of the discharge vessel may be provided with a luminescent layer comprising a luminescent material (for example a fluorescent powder) for converting UV to other wavelengths, for example UV-B and UV-A for tanning purposes (sun-couch lamps), or to visible radiation. For this reason, such lamps are also referred to as fluorescent lamps.

A low-pressure mercury vapor discharge lamp of the type mentioned in the opening paragraph is known from DE-A 1 060 991. In the known lamp, the electrode shield surrounding the electrode is made of titanium sheet. The use of an electrode shield, also referred to as anode shield or cathode shield, counteracts blackening at an inside wall of the discharge vessel. The titanium serves in this respect as the getter for chemically binding oxygen, nitrogen and/or carbon.

A disadvantage of the use of a metal or metal alloy is that it may cause a short-circuit of the pole wires of the electrode. In addition, the metals in the electrode shield may amalgamate with the mercury present in the lamp and, thus, absorb mercury. As a result, to obtain a sufficiently long service life of the known lamp, a relatively high mercury dose is necessary. If the lamp is unskilfully processed after its service life has ended, the environment is adversely affected.

SUMMARY OF THE INVENTION

It is an object of the invention to provide a low-pressure mercury vapor discharge which consumes a relatively small quantity of mercury.

To achieve this, at least one electrode comprises an alkaline earth metal which, in operation, is partly liberated from the electrode, and the electrode shield includes a material which reacts with or forms an alloy with the alkaline earth metal originating from the at least one electrode.

To ensure proper operation of low-pressure mercury vapor discharge lamps, the electrodes of such discharge lamps comprise, in addition to a material with a high melting temperature (a much used metal is tungsten), an (emitter) material with a low so-called work function (reduction of the work function voltage) to supply (emit) electrons to the discharge (cathode function) and receive electrons from the discharge (anode function). Known emitter materials having a low work function are oxides of alkaline earth metals, such as oxides of barium (Ba), strontium (Sr) and calcium (Ca). It has been observed that during operation of low-pressure mercury vapor discharge lamps, (emitter) material is released, for example as a result of alkaline earth metals being liberated from the electrode(s) by evaporation or sputtering. In general, these materials are deposited on the inside wall of the discharge vessel. It has further been found that the alkaline earth metals deposited elsewhere in the discharge vessel no longer participate in the light-generating process. In addition, the deposited (emitter) material forms mercury-containing amalgams on the inside wall, so that the quantity of mercury available for discharge decreases (gradually), which adversely affects the service life of the lamp. In order to counteract such a loss of mercury during the life of the lamp, the lamp requires a relatively high dose of mercury, which is undesirable from the point of view of the environment. Experiments carried out by the inventors have shown that the alkaline earth metals in metallic form amalgamate with mercury and that oxides of alkaline earth metals do not react with mercury. For example, alkaline earth metals in the form of, for example, BaO, SrO, $Ba_3WO_6$, $Sr_3WO_4$, etc., do not form amalgams with mercury, while under comparable conditions, metallic alkaline earth metals bond with mercury, thereby forming, for example, Ba-Hg or Sr-Hg amalgam. The inventors have realized that by providing an electrode shield comprising a material which reacts with or forms an alloy with the alkaline earth metal originating from the electrode(s), the risk that mercury amalgamates is reduced considerably, so that the mercury remains available for discharge and, as a result, the mercury consumption of the discharge lamp is limited.

A preferred embodiment of the low-pressure mercury vapor discharge lamp in accordance with the invention is characterized in that the material of the electrode shield comprises an oxide of a material which oxidizes the alkaline earth metal. By changing the chemical state of alkaline earth metals originating from the electrodes and deposited on the electrode shield from metallic to a suitable metal oxide, the mercury consumption of the discharge lamp is limited. Suitable materials include oxidic materials with more than one oxidation state, whereby the material is not in the lowest oxidation state. Further suitable materials are materials having an oxygen deficiency. Preferably, barium or strontium is used for the alkaline earth metal, and the oxide is selected from the group formed by $MnO_2$, $TiO_2$, $Fe_2O_3$, $In_2O_3$, $SnO_2$, $SnO_2$:Sb, $ZrO_2$, $Nb_2O_5$, $V_2O_5$, $Tb_4O_7$ and ZnO. In contact with metallic alkaline earth metal (originating from the electrode), the corresponding oxide of the alkaline earth metal, i.e. BaO and/or SrO, is formed.

A further preferred embodiment of the low-pressure mercury vapor discharge lamp in accordance with the invention is characterized in that the material of the electrode shield comprises an oxide of a material which is nobler than the alkaline earth metal. Under normal operating conditions of the lamp, such a material oxidizes the alkaline earth metal. As a result, the alkaline earth metal is reduced and does not react with the mercury present in the discharge vessel. Preferably, the alkaline earth metal is barium or strontium, and the oxide is selected from the group formed by copper oxide and iron oxide.

A further preferred embodiment of the low-pressure mercury vapor discharge lamp in accordance with the invention is characterized in that the material of the electrode shield includes a material which liberates water at a temperature which, in operation, is higher than a temperature of the electrode shield. Preferably, the alkaline earth metal is barium or strontium, and the material is an oxide selected from the group formed by $SiO_2$, $Al_2O_3$ (particularly suitable is the so-called Alon-C) and rare earth metal oxides (for example, $La_2O_3$).

A further preferred embodiment of the low-pressure mercury vapor discharge lamp in accordance with the invention is characterized in that the material of the electrode shield includes a metal which forms an alloy with the alkaline earth metal and not with mercury. Preferably, the alkaline earth metal is barium or strontium, and the metal is selected from the group formed by aluminium, zinc, copper, iridium and rhodium.

The electrode shield itself may absorb only a negligible quantity of mercury. To achieve this, the material of the electrode shield comprises at least an oxide of at least one element of the series formed by magnesium, aluminium, titanium, zirconium, yttrium and the rare earths. A particularly preferred embodiment of the low-pressure mercury vapor discharge lamp in accordance with the invention is characterized in that the electrode shield is made from a ceramic material. A particularly suitable electrode shield is manufactured from so-called densely sintered $Al_2O_3$, also referred to as DGA. As a result, the risk that materials in the electrode shield react with mercury present in the discharge vessel to form amalgams is reduced. In addition, the use of an electrically insulating material for the electrode shield precludes a short-circuit of the pole wires of the electrode(s) and/or a shortcircuit of a number of turns of the electrode(s). The known lamp comprises an electrode shield of an electroconductive material which, in addition, relatively readily forms an amalgam with mercury. An additional advantage of the use of aluminium oxide is that an electrode shield made from such a material is resistant to relatively high temperatures. Preferably, in operation, a temperature of the electrode shield is higher than 250° C. At such relatively high temperatures, the risk of a reduction of the (mechanical) strength of the known electrode shield increases, so that the shape of the electrode shield is adversely affected. If a metal or a metal alloy is used as an electrode shield, as in the known discharge lamp, the temperature of the electrode shield may not be too high because otherwise the metal or one of the metals of the metal alloy starts to deform or evaporate and gives rise to undesirable blackening at the inside wall of the discharge vessel. An additional advantage of said relatively high temperatures is that, particularly in the initial phase, the temperature of the electrode shield becomes higher than in the known lamp, as a result of which any mercury bonded to the electrode shield is released more rapidly and more readily.

Alkaline earth metals originating from the electrode(s) and deposited on an electrode shield made from aluminium oxide which is at a considerably higher temperature cannot, or hardly, react, as a result of this high temperature, with mercury present in the discharge, so that the formation of mercury-containing amalgams is at least substantially precluded. In this manner, the use of an electrode shield made from a ceramic material serves a dual purpose. On the one hand, it is effectively precluded that material originating from the electrode(s) is deposited on the inside wall of the discharge lamp, and, on the other hand, it is counteracted that (emitter) material deposited on the electrode shield forms amalgams with mercury present in the discharge lamp.

The shape of the electrode shield and the position thereof with respect to the electrode influence the temperature of the electrode shield. Electrodes in low-pressure mercury vapor discharge lamps are generally elongated and cylindrically symmetric, for example a coil with turns about a longitudinal axis. A tubular electrode shield is particularly suitable for such a shape of the electrode. Preferably, an axis of symmetry of the electrode shield is at least substantially parallel to or coincides approximately with the longitudinal axis of the electrode. In the latter case, the average distance from an inner side of the electrode shield to an external dimension of the electrode is at least substantially constant. Preferably, the electrode shield is further provided with a slit on a side facing the discharge space. A slit in the electrode shield in the direction of the discharge brings about a relatively short discharge path between the electrodes of the low-pressure mercury vapor discharge lamp. This is favorable for a high efficiency of the lamp. The slit preferably extends parallel to the axis of symmetry of the electrode shield (a so-called lateral slit in the electrode shield). In the known lamp, the opening or slit in the electrode shield faces away from the discharge space.

These and other aspects of the invention will be apparent from and elucidated with reference to the embodiments described hereinafter.

BRIEF DESCRIPTION OF THE DRAWINGS

The Figures are purely schematic and not drawn to scale. In particular for clarity, some dimensions are exaggerated strongly. In the Figures, like reference numerals refer to like parts, whenever possible.

DETAILED DESCRIPTION OF THE PREFERRED EMBODIMENTS

Figure 1:
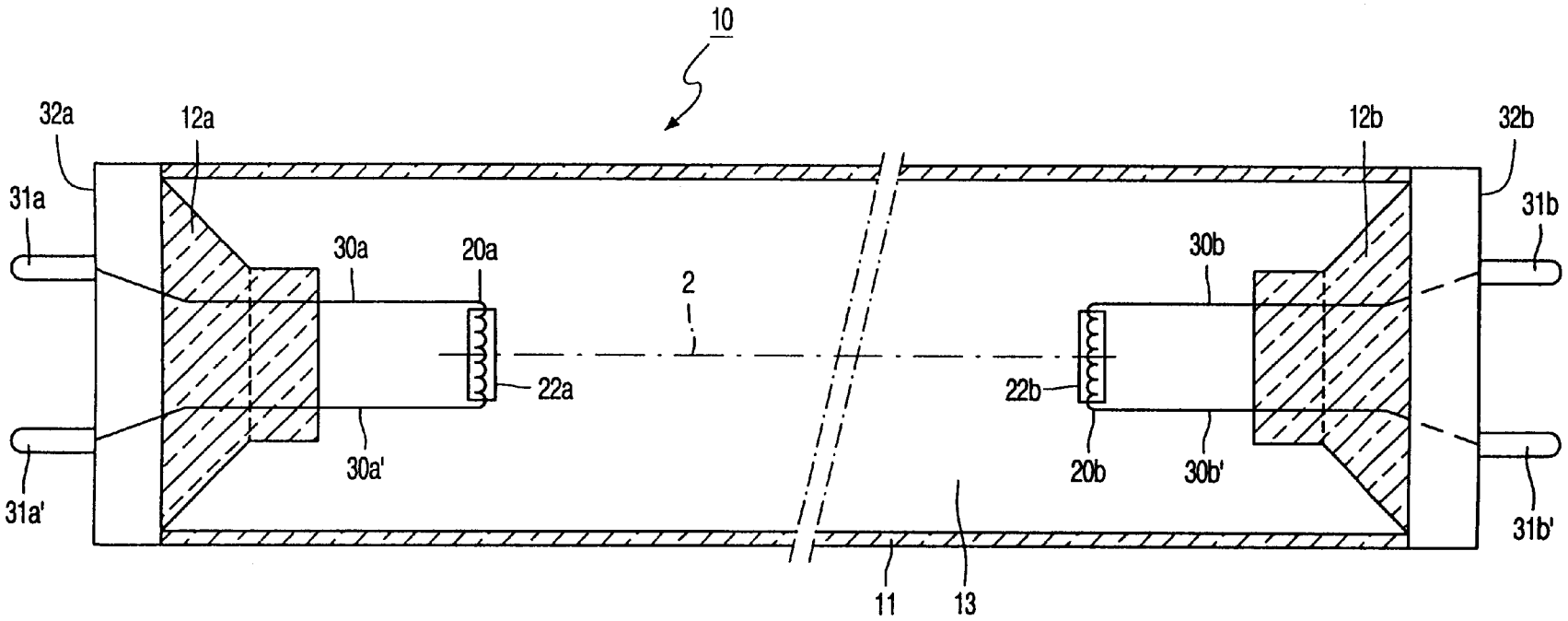
FIG. 1 is a longitudinal cross-sectional view of an embodiment of the lowpressure mercury vapor discharge lamp in accordance with the invention.

FIG. 1 shows a low-pressure mercury vapor discharge lamp comprising a glass discharge vessel 10 with a tubular portion 11 around a longitudinal axis 2, which discharge vessel passes radiation generated in the discharge vessel 10 and is provided with a first and a second end portion 12*a*; 12*b*. In this example, the tubular portion 11 has a length of 120 cm and an inside diameter of 24 mm. The discharge vessel 10 encloses a discharge space 13 in a gastight manner, which discharge space contains a filling of mercury and a noble gas, such as argon. The wall of the tubular portion is generally coated with a luminescent layer (not shown in FIG. 1) comprising a luminescent material (for example a fluorescent powder) which converts the ultraviolet (UV) light generated by a decrement of excited mercury, into (mostly) visible light. End portions 12*a*; 12*b* each support an electrode 20*a*; 20*b*, respectively, arranged in the discharge space 13. The electrode 20*a*; 20*b* is a winding of tungsten covered with an electron-emitting substance, in this case a mixture of barium oxide, calcium oxide and strontium oxide. Of the electrodes 20*a*; 20*b*, current-supply conductors 30*a*, 30*a*'; 30*b*, 30*b*' pass through the end portions 12*a*; 12*b* to the exterior of the discharge vessel 10. The current-supply conductors 30*a*, 30*a*'; 30*b*, 30*b*' are connected to contact pins 31*a*, 31*a*'; 31*b*, 31*b*' which are secured to a lamp cap 32*a*, 32*b*, respectively. In general, an electrode ring (not shown in FIG. 1) is arranged around each electrode 20*a*; 20*b*, on which electrode ring a glass capsule is fixed which serves to dose mercury. In an alternative embodiment, an amalgam comprising mercury and an alloy of PbBiSn is provided in an exhaust tube which is in communication with the discharge vessel 10.

Figure 2:
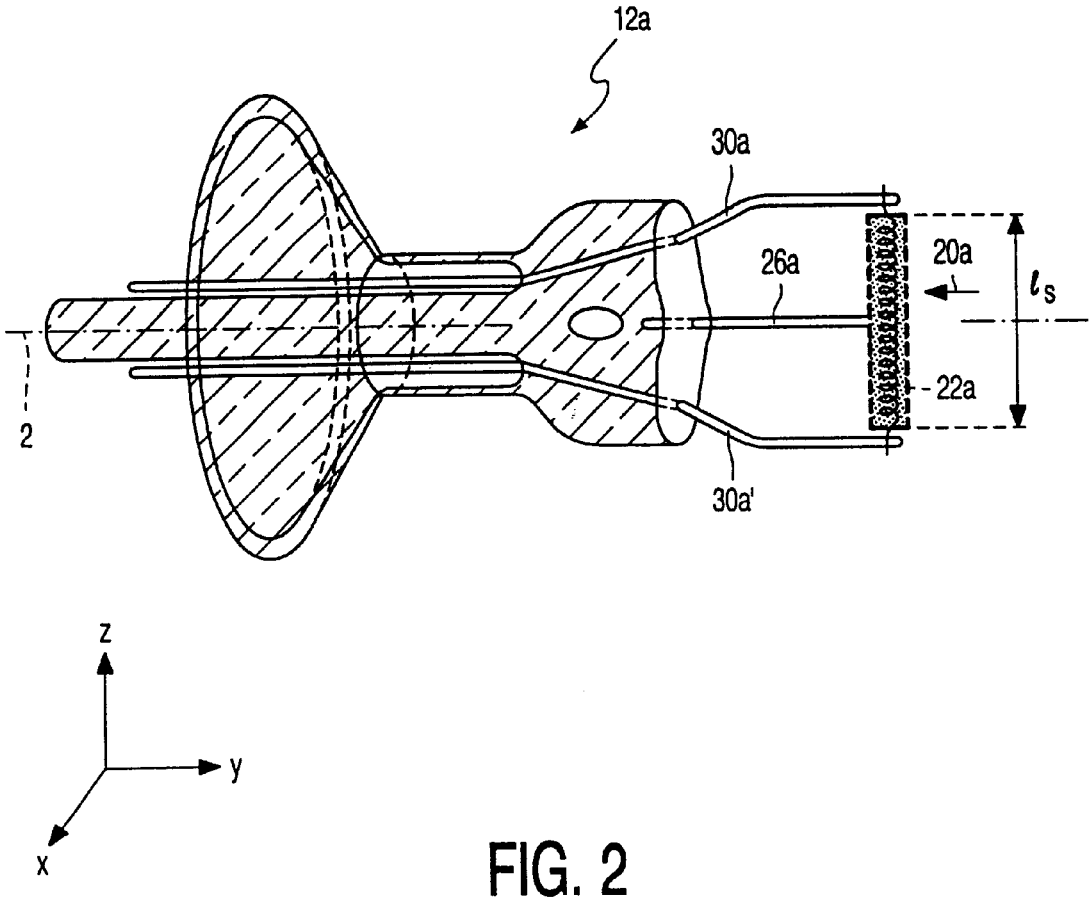
FIG. 2 is a partly perspective view of a detail of FIG. 1.

In the example shown in FIG. 1, the electrode 20*a*; 20*b* is surrounded by an electrode shield 22*a*; 22*b* having a length $l_s$ (see FIG. 2), which, in accordance with the invention, comprises a material which reacts with or forms an alloy with the alkaline earth metal originating from the electrodes 20*a*; 20*b*. Preferably, the electrode shield 22*a*; 22*b* is made from a ceramic material and covered with the material which reacts with or forms an alloy with alkaline earth metals. FIG. 2 shows, partly in perspective, a detail of FIG. 1, in which the end portion 12*a* supports the electrode 20*a* via the current-supply conductors 30*a*, 30*a*'. A tubular (cylindrically symmetric) electrode shield 22*a* is situated around the electrode 20*a*, which electrode shield is supported by a supporting wire 26*a* provided in the end portion 12*a*. Preferably, the electrode shield 22*a* is provided, on the side of the discharge lamp facing the discharge, with a lateral slit (not shown in FIG. 2).

The electrode shield precludes (emitter) material originating from the electrode from being deposited on the inner wall of the discharge vessel, thereby causing undesirable blackening. The electrode shield in accordance with the invention brings about that (emitter) material deposited on the ceramic electrode shield during operation of the low-pressure mercury vapor discharge lamp has such a high temperature that the material cannot form mercury-containing amalgams, so that a substantial reduction of the mercury consumption of the lamp is achieved.

Experiments have shown that a low-pressure mercury vapor discharge lamp provided with a tubular electrode shield made of DGA and provided with a layer of $Fe_2O_3$, the electrode shield being provided around the electrode, exhibits a mercury consumption in the region of the electrode of less than 4 $\mu$g after 100 burning hours on a so-called high frequency regulating (HFR) dimming ballast, while a reference lamp provided with the known electrode shield exhibits a mercury consumption in the region of the electrode of more than 20 $\mu$g. After 10,000 burning hours, the reference lamps operated on such a ballast can no longer be ignited for lack of mercury. Such a service life is substantially lower than the customary service life of these discharge lamps, which amounts to approximately 17,000 hours. Low-pressure mercury vapor discharge lamps comprising an electrode shield provided with a material which reacts or forms an alloy with alkaline earth metals, and which electrode shield is preferably made of a ceramic material, meet the specification of the specified service life. The metallic barium and strontium originating from the emitter material of the electrodes is converted on the electrode shield to the corresponding oxides, so that the reaction of the metallic barium and strontium with mercury, resulting in the formation of amalgams, is precluded.

Figure 3:
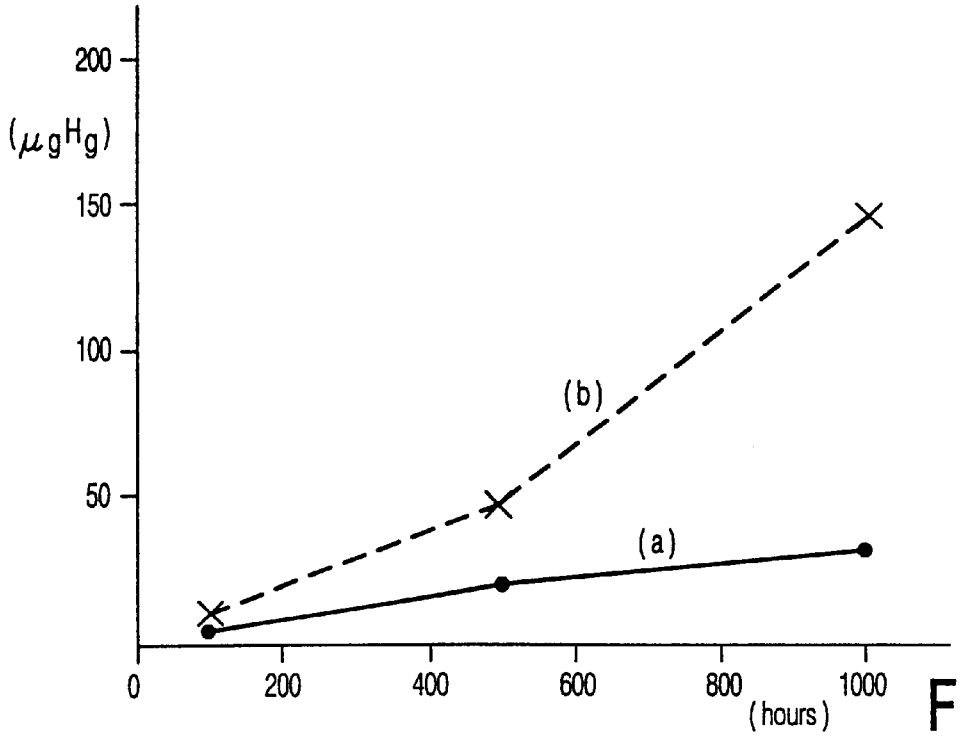
FIG. 3 shows the mercury consumption of a low-pressure mercury vapor discharge lamp having an electrode shield in accordance with the invention, which is operated on a cold-start ballast with a short cycle, relative to the mercury consumption of a known discharge lamp.
Figure 4:
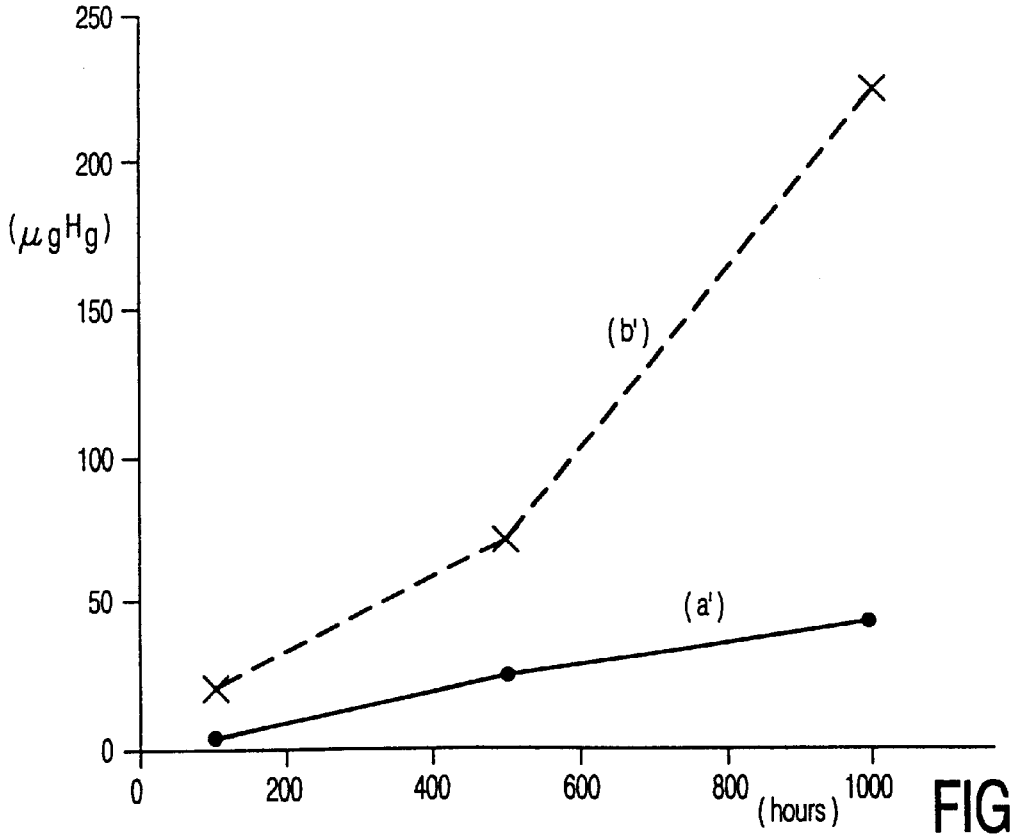
FIG. 4 shows the mercury consumption of a low-pressure mercury vapor discharge lamp having an electrode shield in accordance with the invention, which is operated on a dimming ballast with a long cycle, relative to the mercury consumption of a known discharge lamp.

In further experiments, low-pressure mercury vapor discharge lamps manufactured in accordance with the invention were compared to known discharge lamps. FIG. 3 shows the mercury consumption of a low-pressure mercury vapor discharge lamp comprising an electrode shield in accordance with the invention, in comparison with the mercury consumption of a known discharge lamp, the discharge lamps being operated on a so-called cold-start ballast with a short switching cycle in which a burning period of 15 minutes is alternated with a switched-off period of 5 minutes. After 1000 burning hours, the electrode comprising a tubular DGA electrode shield covered with a layer of $Fe_2O_3$ demonstrated a mercury consumption in the region of the electrode of 30 $\mu$g (curve a), while the known lamp exhibited a mercury consumption in the region of the electrode of 148 $\mu$g (curve b). As a result of the use of the electrode shield in accordance with the invention, the mercury consumption in the region of the electrode is reduced by approximately 70%. In FIG. 4, the mercury consumption of a low-pressure mercury vapor discharge lamp comprising an electrode shield in accordance with the invention is compared to the mercury consumption of a known discharge lamp, the discharge lamps being operated on a dimming ballast for 1000 burning hours with a long switching cycle in which burning periods of 165 minutes are alternated with switched-off periods of 15 minutes. After 1250 hours, the electrode comprising a tubular DGA electrode shield covered with a layer of $Fe_2O_3$ exhibited a mercury consumption in the region of the electrode of 45 $\mu$g (curve a'), while the known lamp exhibited a mercury consumption in the region of the electrode of 225 $\mu$g (curve b'). This comparison shows that the known discharge lamp has a considerably higher mercury consumption during its service life than the discharge lamp comprising an electrode shield in accordance with the invention.

It will be obvious that within the scope of the invention many variations are possible to those skilled in the art. The discharge vessel does not necessarily have to be elongated and tubular, other shapes are alternatively possible. In particular, the discharge vessel may have a curved shape (for example meander-shaped).

The invention is embodied in each novel characteristic and each combination of characteristics.

What is claimed is:

1. A low-pressure mercury vapor discharge lamp comprising:

a discharge vessel which encloses a discharge space provided with a filling of mercury and a noble gas in a gastight manner, a pair of electrodes arranged in the discharge space for generating and maintaining a discharge in the discharge space, at least one of the pair of electrodes comprising an alkaline earth metal which, in operation, is partly liberated, and an electrode shield at least substantially surrounding at least one of the pair of electrodes, wherein the electrode shield includes a material which reacts with or forms an alloy with the alkaline earth metal originating from the at least one of the pair of electrodes, wherein the material of the electrode shield comprises an oxide of another material which is nobler than the alkaline earth metal, said alkaline earth metal being barium or strontium and the oxide is selected from a group formed by copper oxide and iron oxide.

2. A low-pressure mercury vapor discharge lamp as claimed in claim 1, wherein said another material oxidizes the alkaline earth metal.

3. A low-pressure mercury vapor discharge lamp as claimed in claim 2, wherein the alkaline earth metal is barium or strontium and that the oxide is selected from the group formed by $MnO_2$, $TiO_2$, $Fe_2O_3$, $In_2O_3$, $SnO_2$, $SnO_2$:Sb, $ZrO_2$, $Nb_2O_5$, $V_2O_5$, $Tb_4O_7$ and ZnO.

4. A low-pressure mercury vapor discharge lamp as claimed in claim 1, wherein the material of the electrode shield includes another material which liberates water during operation of said lamp.

5. A low-pressure mercury vapor discharge lamp as claimed in claim 4, wherein the alkaline earth metal is barium or strontium, and the material is an oxide selected from the group formed by $SiO_2$, $Al_2O_3$ and rare earth metal oxides.

6. A low-pressure mercury vapor discharge lamp as claimed in claim 1, wherein the material of the electrode shield includes a metal which forms an alloy with the alkaline earth metal and not with mercury.

7. A low-pressure mercury vapor discharge lamp as claimed in claim 6, wherein the alkaline earth metal is barium or strontium and the metal is selected from the group formed by aluminium, zinc, copper, iridium and rhodium.

8. A low-pressure mercury vapor discharge lamp as claimed in claim 1, wherein the electrode shield is made from a ceramic material.

9. A low-pressure mercury vapor discharge lamp as claimed in claim 1, wherein, in operation, a temperature of the electrode shield is higher than 250° C.

10. A discharge lamp comprising:

a discharge vessel which encloses a discharge space filled with mercury and a noble gas;

an electrode to generate a discharge in the discharge space, said electrode comprising an alkaline earth metal element in element form; and a shield which substantially surrounds said electrode;

wherein said shield includes a material which reacts with or forms an alloy with the alkaline earth metal element.

11. The discharge lamp of claim 10, wherein said material does not include $V_2O_5$.

12. The discharge lamp of claim 10, wherein said material comprises an oxide of another material which oxidizes the alkaline earth metal, said another material not including vanadium.

13. The discharge lamp of claim 10, wherein said material comprises an oxide of another material which oxidizes the alkaline earth metal; said oxide not including $V_2O_5$, and said another material not including vanadium.

14. The discharge lamp of claim 10, wherein said alkaline earth metal is barium or strontium and said material is selected from a group formed by $MnO_2$, $TiO_2$, $Fe_2O_3$, $In_2O_3$, $SnO_2$, $SnO_2$:Sb, $ZrO_2$, $Nb_2O_5$, $Tb_4O_7$, ZnO, $SiO_2$, $Al_2O_3$ and copper oxide.

15. The discharge lamp of claim 10, wherein said material includes another material which liberates water during operation of said lamp.

16. The discharge lamp of claim 10, wherein said material includes a metal which forms an alloy with said alkaline earth metal and not with mercury.

17. The discharge lamp of claim 10, wherein said alkaline earth metal is barium or strontium and said material is a metal selected from a group formed by aluminum, zinc, copper, iridium and rhodium.

18. The discharge lamp of claim 10, wherein said shield is made from a ceramic material.

* * * * *